US005297565A

United States Patent [19]

Charitar et al.

[11] Patent Number: 5,297,565

[45] Date of Patent: Mar. 29, 1994

[54] BRISTLE FOR HAIR STIMULATOR

[76] Inventors: Satendra Charitar, 5154 Shelter Creek La., San Bruno, Calif. 94066; George Spector, 233 Broadway Rm 702, New York, N.Y. 10279

[21] Appl. No.: 79,396

[22] Filed: Jun. 21, 1993

[51] Int. Cl.[5] ..... A45D 24/22

[52] U.S. Cl. ..... 132/114; 132/152; 401/28; 401/176; 401/268

[58] Field of Search ..... 132/112, 113, 114, 115, 132/116, 120, 137, 148, 151, 152, 153, 154; 401/22, 28, 176, 268; 128/67

[56] References Cited

U.S. PATENT DOCUMENTS

| | | | |
|---|---|---|---|
| 671,047 | 4/1901 | Fox | 132/114 |
| 1,062,053 | 5/1913 | Strong | 401/28 |
| 1,235,404 | 7/1917 | Wehrsen | 132/112 |
| 1,570,013 | 1/1926 | Smith | 132/114 |
| 1,607,674 | 11/1926 | Ives | 132/114 |
| 2,624,348 | 1/1953 | Matson | 132/114 |
| 3,456,658 | 7/1969 | Long, Jr. | 132/116 |
| 5,054,504 | 10/1991 | Winrow | 132/114 |
| 5,116,253 | 5/1992 | Charitar et al. | 132/114 |

FOREIGN PATENT DOCUMENTS

| | | | |
|---|---|---|---|
| 869247 | 7/1949 | Fed. Rep. of Germany | 132/114 |
| 325309 | 3/1935 | Italy | 132/114 |
| 486528 | 11/1953 | Italy | 132/114 |
| 7460 | of 1907 | United Kingdom | 132/114 |

*Primary Examiner*—Gene Mancene
*Assistant Examiner*—Frank A. LaViola

[57] ABSTRACT

An improved hair shampoo stimulator device is provided in which each bristle is shaped similar to a finger tip, for the purpose of safely stimulating the scalp of a person without damaging the hair.

2 Claims, 1 Drawing Sheet

BRISTLE FOR HAIR STIMULATOR

BACKGROUND OF THE INVENTION

The instant invention relates generally to liquid dispensing brushes and more specifically it relates to ail improved hair shampoo stimulator device, which provides each bristle looking like a finger tip to safely stimulate the scalp of a person.

There are available various conventional liquid dispensing brushes which do not provide the novel improvements of the invention herein disclosed.

SUMMARY OF THE INVENTION

A primary object of the present invention is to provide an improved hair shampoo stimulator device that will overcome the shortcomings of the prior art devices.

Another object is to provide an improved hair shampoo stimulator device in which each bristle is shaped similar to a finger tip, for the purpose of safety stimulating the scalp of a person without damaging the hair.

An additional object is to provide an improved hair shampoo stimulator device in which each bristle can be removed from and replaced to the frame of the device when the need arises.

A further object is to provide an improved hair shampoo stimulator device that is simple and easy to use.

A still further object is to provide an improved hair shampoo stimulator device that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 1:
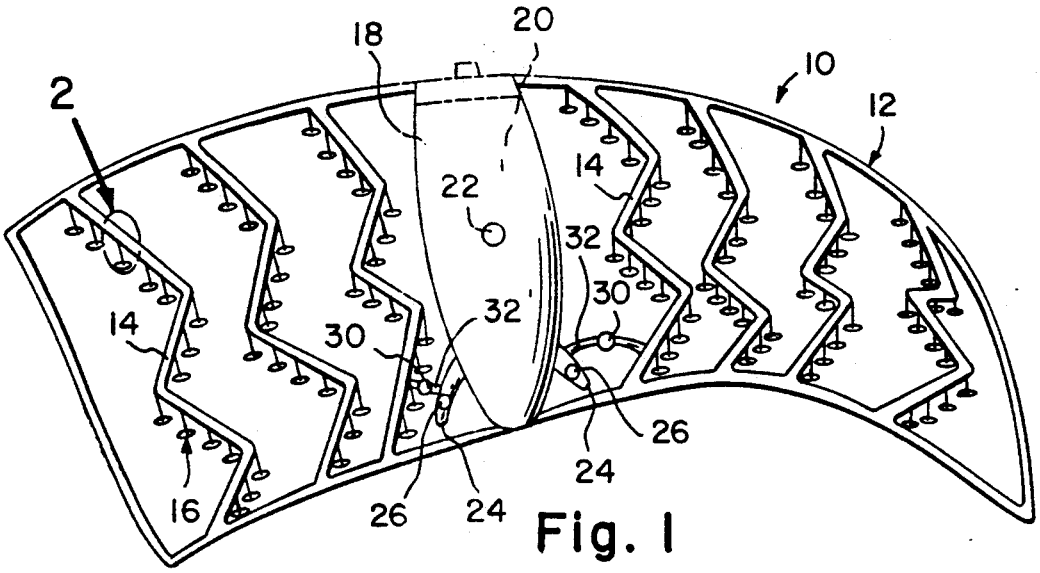
FIG. 1 is a diagrammatic perspective view of the instant invention.

Turning now descriptively to the drawings, in which similar reference characters denote similar elements throughout the several views, FIG. 1 illustrates an improved hair shampoo stimulator device 10, which consists of a rectangular shaped open frame 12 being slightly curved downwardly. A plurality of zig zag supports 14 are affixed to and extend across a narrow portion of the frame 12 in spaced apart relationships. A plurality of bristles 16 are provided, with each shaped similar to a finger tip and extends downwardly from each support 14. A container 18 is affixed to and extends across a center of the narrow portion of the frame 12 with the supports 14 arranged substantially uniformly therefrom. The container 18 has a chamber 20 for holding shampoo solution therein. a manually operable pump 22 is reciprocally carried within the container 18. A pair of nozzles 24 are also provided, with each fluidly connected to one bottom edge of the container 18. When the pump 22 is actuated the nozzles 24 will spray some of the shampoo solution out of the chamber 20 onto a scalp of a person, allowing the bristles 16 to foam the shampoo solution and massage the scalp of the person to stimulate hair roots without damaging the hair.

Each nozzle 24 further includes a one way check valve 26, to allow some of the shampoo solution to spray out therefrom when the pump 22 is activated and to prevent air from entering the chamber 20, when the pump 22 is deactivated.

The frame 12, the zig zag supports 14 and the bristles 16 have hollow interconnecting channels 28 therethrough. Each nozzle 24 has a second one way valve 30 fluidly connected via a tube 32 to the channel 28 in the adjacent zig zag support 14. When the pump 22 is activated some of the shampoo solution will travel through the channels 28 and out of the bottom ends of the bristles 16.

Figure 2:
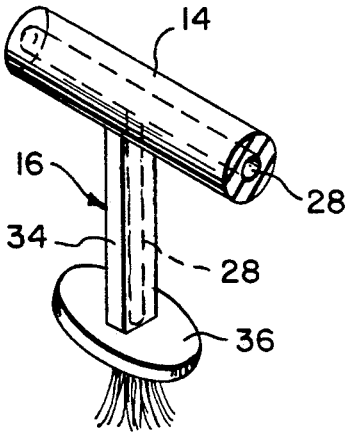
FIG. 2 is an enlarged perspective view of one of the bristles as indicated by arrow 2 in FIG. 1.
Figure 3:
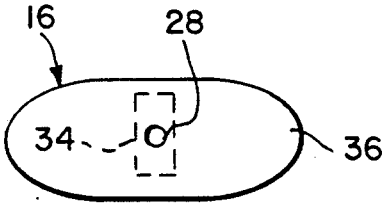
FIG. 3 is a bottom view taken in direction of arrow 3 in FIG. 2.
Figure 4:
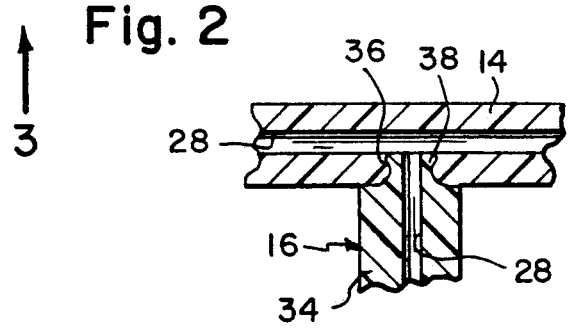
FIG. 4 is a cross sectional view of a modification showing a removable bristle connected to the frame.
Figure 5:
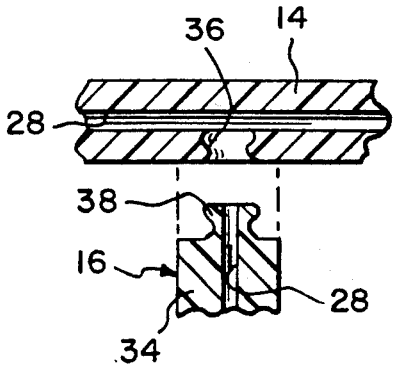
FIG. 5 is an exploded cross sectional view of FIG. 4, showing the removable bristle separated from the frame.

Each bristle 16, as best seen in FIGS. 2 and 3, includes a rectangular shaped shank 34 and an oval base 36, with the channel 28 extending through the shank 34 and out of the base 36. Each zig zag support 14 has a female sockets 36 extending downward therefrom, which are fluidly connected to the channel 28 therethrough. One socket 36 is shown in FIGS. 4 and 5. Each bristle 16 has a male plug 38 on a top end of the shank 34 that can be removably connected to one of the female sockets 36 in the zig zag support 14. In one instance a bristle 16 can be fluidly connected to the zig zag support 14. In another instance the bristle 16 can be. fluidly disconnected from the zig zag support 14. This allows the bristles 16 to be replaced when needed.

OPERATION OF THE INVENTION

To use the improved hair shampoo stimulator device 10, a person simply fills the container 18 with shampoo solution. The frame 12 is placed upon the head of the person and the pump 22 is manually pressed to be activated, causing some of the shampoo solution to exit the nozzles 24 and each of the bristles 16. The base 36 of each bristle 16 is rubbed into the scalp to foam the shampoo solution and stimulate the hair roots without damaging the hair.

While certain novel features of this invention have been shown and described and are pointed out in the annexed claims, it will be understood that various omissions, substitutions and changes in the forms and details of tile device illustrated and in its operation can be made by those skilled in the art without departing from the spirit of the invention.

What is claimed is:

1. An improved hair shampoo stimulator device which comprises:

a rectangular shaped open frame being slightly curved downwardly;

a plurality of zip zag supports affixed to and extending across a narrow portion of said frame in spaced apart relationships;

a plurality of bristles each shaped similar to a finger tip and extending downwardly from each said support;

a container affixed to and extending across a center of the narrow portion of said frame with said supports arranged substantially uniformly therefrom, said container having a chamber for holding shampoo solution therein;

a manually operable pump reciprocally carried within the container; and a pair of nozzles, each fluidly connected to one bottom edge of said container, so that when said pump is actuated said nozzles will spray some of the shampoo solution out of the chamber onto a scalp of a person, each said nozzle further including a first one way check valve to allow some of the shampoo solution to spray out therefrom when said pump is activated and to prevent air from entering the chamber when the pump is deactivated;

said frame, said zig zag supports and said bristles having hollow interconnecting channels therethrough and each of said nozzles further having a second one way check valve fluidly connected to said channel to an adjacent zig zag support so that when said pump is activated some of the shampoo solution will travel through said channels and out of bottom ends of said bristles;

each of said bristles including a rectangular shaped shank and an oval base attached perpendicularly to a distal end of said shank with said channel extending through said shank and out of said base;

whereby said bristles are allowed to foam the shampoo solution and massage the scalp of the person to stimulate hair roots without damaging hair.

2. An improved hair shampoo stimulator device as recited in claim 1, further including:

a) each said zig zag support having a plurality of spaced apart female sockets extending downwardly therefrom, which are fluidly connected to said channel therethrough; and b) each said bristle having a male plug on a top end of said shank that can be removably connected to one of said female sockets in said zig zag support, thereby in one instance said bristle can be fluidly connected to said zig zag support and in another instance said bristle can be fluidly disconnected from said zig zag support, to allow said bristles to be replaced when needed.

* * * * *